US005651191A

United States Patent [19]

Walunas et al.

[11] Patent Number: 5,651,191

[45] Date of Patent: Jul. 29, 1997

[54] MATERIAL TREATMENT SYSTEM

[75] Inventors: Ronald M. Walunas, Amesbury; Philip G. Milone, Burlington, both of Mass.

[73] Assignee: Wolverine Corporation, Merrimac, Mass.

[21] Appl. No.: 508,799

[22] Filed: Jul. 28, 1995

[51] Int. Cl.[6] ..... F26B 19/00

[52] U.S. Cl. ..... 34/236; 34/216; 198/952

[58] Field of Search ..... 34/216, 217, 236; 198/952, 849, 850

[56] References Cited

U.S. PATENT DOCUMENTS

| | | | |
|---|---|---|---|
| Re. 34,814 | 1/1995 | Magaldi | 198/850 |
| 456,732 | 7/1891 | Mey | 34/236 |
| 860,233 | 7/1907 | Ogburn . | |
| 865,591 | 9/1907 | Horst | 198/850 |
| 1,089,657 | 3/1914 | Maddux . | |
| 1,873,865 | 8/1932 | Allsop | 198/849 |
| 2,261,049 | 10/1941 | Bokum . | |
| 3,391,472 | 7/1968 | Landers . | |
| 3,621,891 | 11/1971 | Eisenberg . | |
| 3,744,777 | 7/1973 | Marsh | 34/236 |
| 4,031,005 | 6/1977 | Der . | |
| 4,109,394 | 8/1978 | Hoyt | 34/57 B |
| 4,155,491 | 5/1979 | Istoshin et al. . | |
| 4,384,463 | 5/1983 | Rica et al. | 198/952 |
| 4,419,834 | 12/1983 | Scott | 34/217 |
| 4,744,714 | 5/1988 | Cross et al. | 198/850 |
| 4,750,277 | 6/1988 | Kuhl | 34/236 |
| 5,213,203 | 5/1993 | Kinney et al. | 198/850 |

OTHER PUBLICATIONS

Jet–Pro, "What to Expect from a Jet Pro Roaster," 2 pages, 1993.

*Primary Examiner*—Edward K. Look
*Assistant Examiner*—Mark Sgantzos
*Attorney, Agent, or Firm*—Fish & Richardson P.C.

[57] ABSTRACT

A material treatment system for treatment of particulate material includes a transport conveyor including a transport surface for transporting particulate material through a treatment zone, conveying compartments attached to the transport surface, and foraminous cover structure travelling with and covering the conveying compartments. The system further includes a supply plenum above the treatment zone, a gas flow system for placing particles on the conveyor in fluidized condition as they move through the treatment zone, and exhaust structure for moving gases from the treatment zone upwardly away from the treatment zone. The conveying compartments and foraminous cover retain particulate material being fluidized and provide increased control of the position and movement of the particles passing through the treatment zone of the system.

21 Claims, 6 Drawing Sheets

MATERIAL TREATMENT SYSTEM

BACKGROUND OF THE INVENTION

This invention relates to material treatment systems that employ a gaseous medium to fluidize particles in heat exchange or other treating relation and more particularly to particulate treatment systems suitable for use with transport mechanisms of the belt conveyor or similar type.

Particulate material is advantageously treated by maintaining the particles in fluidized conditions as they are transported through a particle treatment zone. The particles may be fluidized by a gas flow that is in heat exchange or other treating relation with the particles. Such systems find extensive use in the food industry for processing particles such as coffee beans, grains, cereal flakes, fruit, etc., and in other industries for promoting or retarding chemical reactions, for driving off free or absorbed liquids or moisture or for otherwise conditioning granular, pulverent and other particulate materials.

In a conventional air fluidizing treatment system, variations in the treatment time of the product particles may cause non-uniformity in the finished product. With certain food products having relatively short treatment times at high temperatures (e.g., puffed snack foods), this variation may be detrimental. For example, puffed corn curls are often in pellet form before being treated. Normally, no more than 30 to 40 seconds of exposure to heated air is required for the pellets to expand as much as ten times in size. If the pellets are under-treated, they may only expand partially or not at all. On the other hand, over-treating the curl product will result in burning and discoloration. The expansion of the curl product exacerbates the problem of forward and backward excursion since their light weight and increased surface area in their puffed state allows them to be randomly and more easily thrown about the conveyor bed.

Another example of a product which might be desirably treated in such a system is infused blueberries. Infused blueberries are permeated with a sugar-sweetened syrup and then treated within the system to provide partially dried blueberries which are typically blended, for example, with ready-to-eat breakfast cereals or baked goods. Unless they are continually tumbled and separated from each other, the infused blueberries may agglomerate into clusters making them difficult to dry. The velocity of the heated air must be high enough to overcome particle to particle adhesion, but vigorous fluidization can cause product carryover, loss in the exhaust air stream, excessive product contact and deposits on the air delivery tubes and treatment chamber walls. Moreover, vigorous fluidization can cause the loss of residence time distribution control which adversely affects the uniform treatment of the product.

SUMMARY OF THE INVENTION

In accordance with one aspect of the invention, a material treatment system includes structure defining a particle treatment zone, the structure having imperforate transport conveyor structure for transporting particulate material through the particle treatment zone that includes structure defining the lower boundary of said particle treatment zone, conveying compartment structure for transporting the particulate material through the treatment zone, and foraminous retention structure that travels with and retains the particulate material within the conveying compartments. The material treatment system further includes a gas flow system disposed above the particle treatment zone, arranged to project gaseous streams downwardly through the foraminous retention structure to fluidize the particulate material retained within the conveying compartments. Exhaust structure moves gases away from the particle treatment zone.

In a particular embodiment, the conveying compartment structure includes a series of individual conveying compartments. For example, the series of individual conveying compartments may include an impervious planar bottom surface of the transport conveyor structure, vertically extending spaced-apart side wall members extending across the width of the transport conveyor structure, and vertically extending end wall members extending along the travelling length of the transport conveyor structure. The side wall members are transverse to the end wall members, and the foraminous retention structure is an endless member that is substantially in contact with the spaced-apart side wall and end wall members when the compartments are within the particle treatment zone.

In another embodiment, each individual conveying compartment is defined by a pair of interlinking subassemblies, attached to adjacent compartment base members. Each subassembly includes a vertically extending side wall extending across the width of the transport conveyor structure, opposed vertically extending end walls disposed in the direction of the travelling length of the transport conveyor structure, and foraminous retention structure offset from its base member in cantilever fashion. The pair of vertically extending opposed end walls, a vertically extending side wall, and foraminous retention structure of one interlinking subassembly and a vertically extending side wall of the adjacent interlinking subassembly forms an individual conveying compartment. The foraminous retention member may include a continuous-travelling screen or perforated metal plate with the size and spacing of holes in the plate or mesh size of the travelling screen dependent upon the size and type of particulate material being processed. The size of the holes in the plate or screen is typically less than ninety percent of the smallest dimension of the particulate material. The transport conveyor structure in a particular embodiment includes an endless belt of interconnected stainless steel slats or flights that has a width of about ¾ meter and a length of two meters or more. The gas flow system includes an array of nozzles arranged to project gaseous streams within the conveying compartments, the vertical spacing between the ends of the nozzle array and the foraminous retention structure being between 0.5 and 3.0 centimeters.

In accordance with another aspect of the invention, a particle treatment system includes structure defining a particle treatment zone including a belt type conveyer that has an imperforate surface defining the lower boundary of the particle treatment zone and being arranged for transporting particulate material through the treatment zone, a supply plenum above the particle treatment zone, an array of nozzles arranged to project gaseous streams downwardly from the supply plenum against the conveyor surface for fluidizing particles on the conveyer, means for exhausting gases from the treatment zone upwardly away from the conveyer, conveying compartment structure secured to the belt type conveyer for transporting the particulate material through the particle treatment zone, and foraminous retention structure disposed between the nozzles and the conveying compartment structure, the foraminous retention structure being adapted to travel with and retain particulate material within the conveying compartment structure. Preferably, the gaseous streams have a velocity of at least one thousand meters per minute.

In a particular embodiment, the belt type conveyor includes a series of flights that are hingedly interconnected, and the foraminous retention structure includes a series of screen members, each screen member having a width corresponding to the width of a conveyor flight and being longitudinally offset from the conveyor flight on which it is mounted. Further, each conveying compartment comprises a bottom defined by the belt type conveyor surface, a vertically extending side wall extending across the width of the belt type conveyor, and vertically extending end walls extending along the travelling length of the belt type conveyor structure, the end walls being transverse to the side wall, and a screen member is secured to the side wall and end walls of each compartment.

Preferably, the foraminous retention structure has a multiplicity of holes, each hole having a dimension less than about ninety percent of a smallest dimension of the particulate material to be processed, the holes have a width dimension of less than two centimeters, and the foraminous retention structure is parallel to the belt type conveyer in the treatment zone and spaced between 0.5 and 3.0 centimeters from the lower ends of the nozzles.

The invention provides an efficient particle treatment system which contributes to the particle retention action and is particularly useful in conjunction with particle transport mechanisms of the endless belt type. The particle treatment system of the invention provides near "plug-flow" product conveyance (i.e., the product exits the system in the order that it is provided to the system). In other words, the product particles are constrained so that they substantially move with the conveyor while being fluidized, thereby providing substantially uniform treatment of each product particle passing through the treatment zone of the system. In addition, containment of the particulate materials within the conveying compartment structure prevents the product from exiting the treatment region prematurely, as by exhaust carryover, and from impacting and accumulating on treatment chamber surfaces (e.g., sidewalls, air nozzles, etc.).

The foraminous retention structure and the conveyor compartments of the conveyor preferably move together at similar speeds with the possibility of any particle product finding its way between the surfaces of the retention structure and compartment walls during fluidization being minimized. Thus, the particulate product is less likely to be crushed, ground, or otherwise mutilated. This is an advantage for softer or spongier material products (e.g., infused fruit), as well as other products.

BRIEF DESCRIPTION OF THE DRAWING

Other features and advantages of the invention will be seen as the following description of particular embodiments progresses, in conjunction with the drawings in which.

DESCRIPTION OF PARTICULAR EMBODIMENTS

Figure 1:
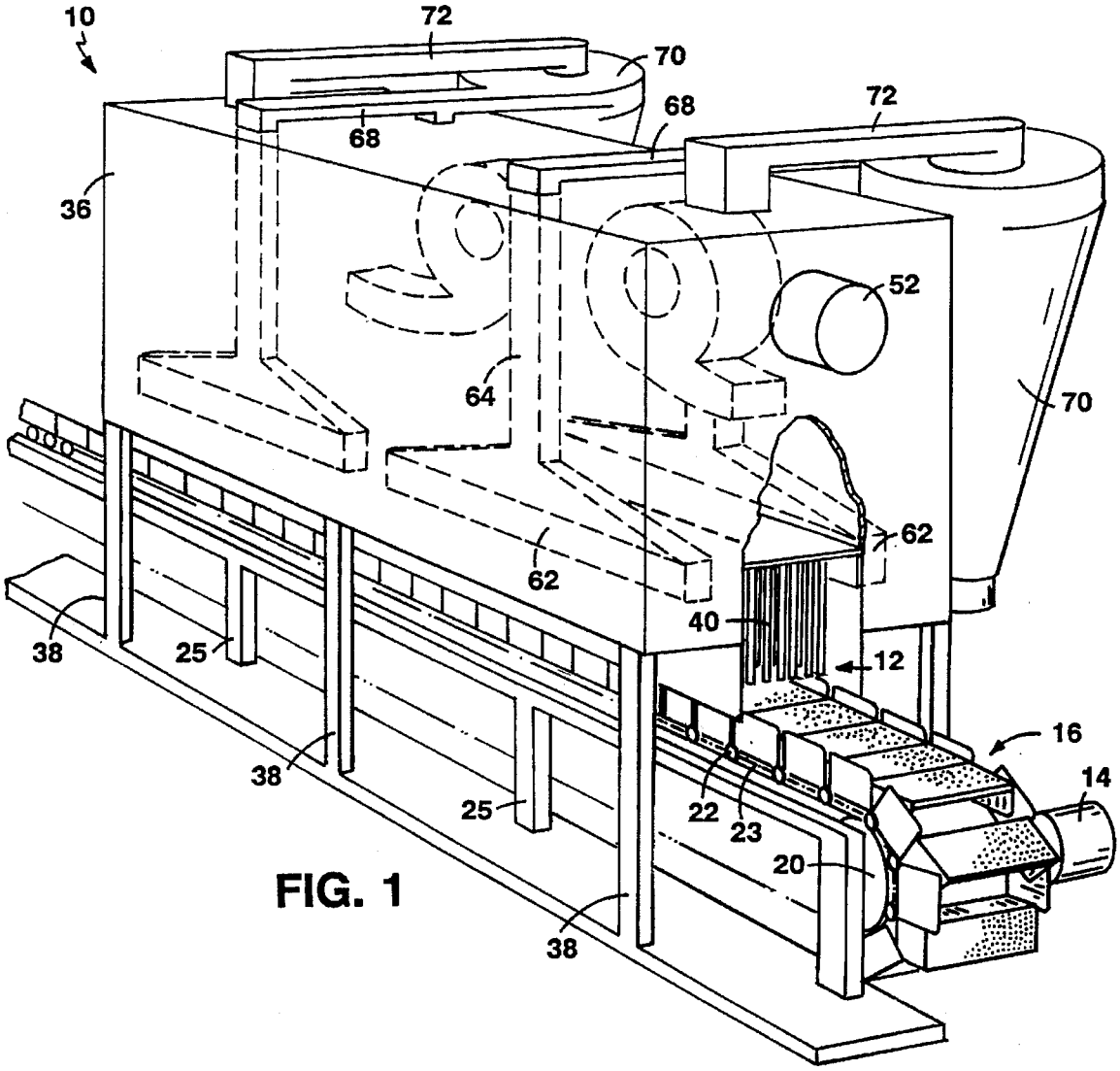
FIG. 1 is a perspective view of a particle treatment system in accordance with the invention.
Figure 3:
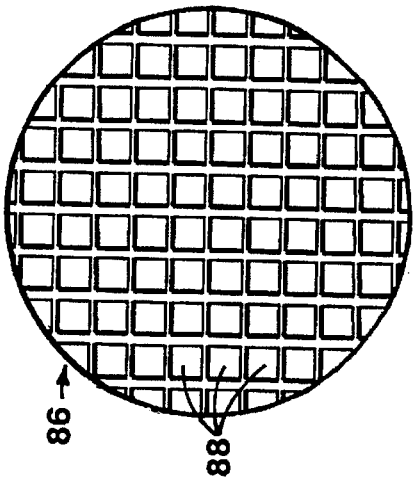
FIG. 3 is an enlarged view of a portion of the foraminous retention member of FIG. 2.
Figure 2:
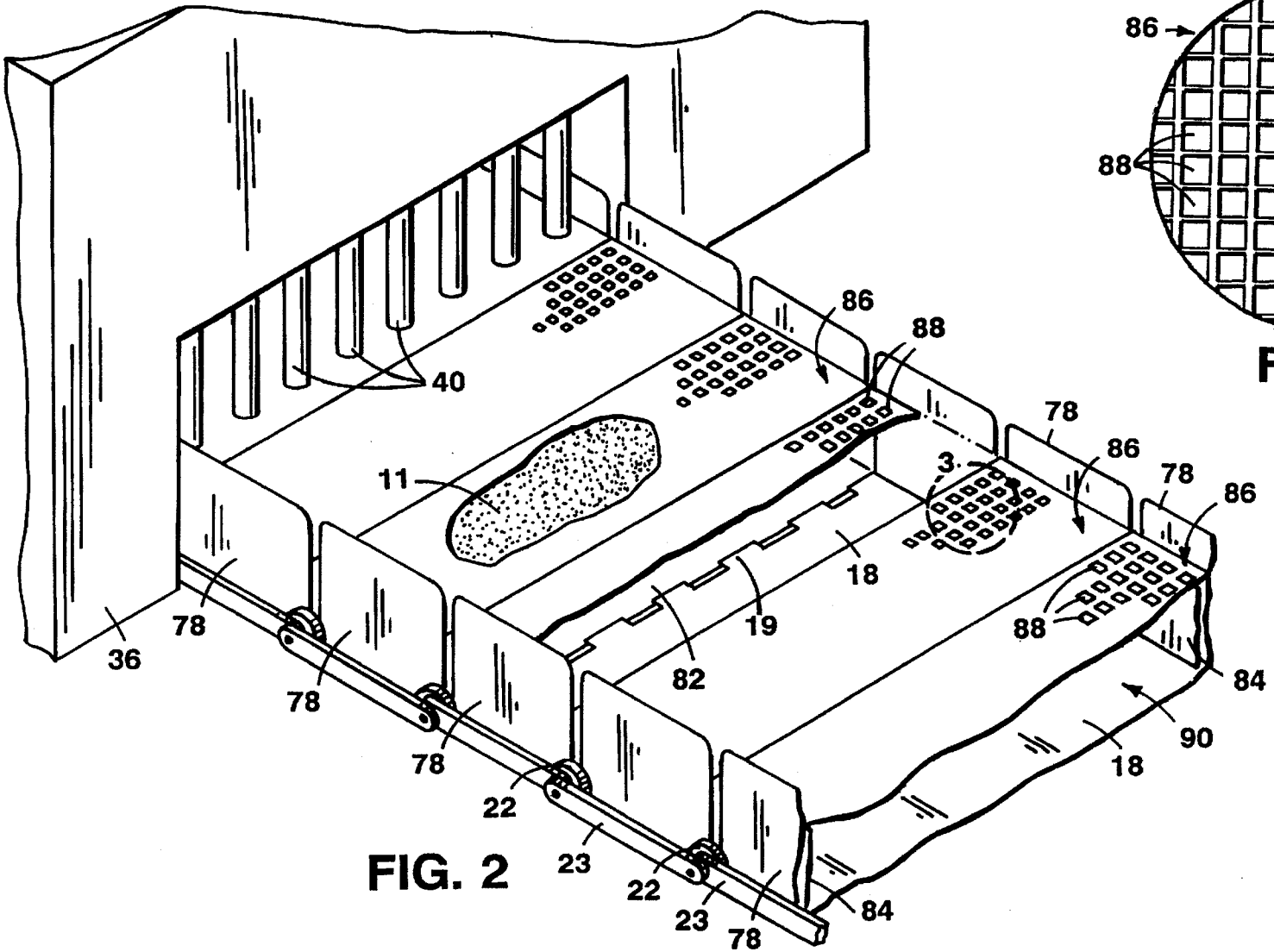
FIG. 2 is a perspective view of a portion of the system shown in FIG. 1, with a portion broken away.

Referring to FIGS. 1–5, a material treatment system 10 for transporting particulate material 11 (FIG. 2) includes an elongated treatment zone 12 having a length of about three meters and a width of about ¾ meter. The system further includes an air flow system that provides a flow of heated air for fluidizing the particulate material as it is transported through treatment zone 12 by a compartmented conveyor system 16 driven by motor 14. The air flow system is similar to that described in U.S. Pat. No. 4,109,394, assigned to the assignee of the present application and hereby incorporated by reference. System 16 includes an articulated belt type base composed of carbon steel or stainless steel flights or slats 18 (FIG. 2) that are flexibly hinged together (at 19) so that they fit closely and form a flat moving support base in the treatment zone, while also permitting the conveyor assembly to traverse sprockets 20 at either end of the conveyor. The support base flights may be formed of other material such as plastic or coated fabric. Each individual flight 18 has a width of about ¾ meter and a length (pitch) of about 15 centimeters. The conveyor system includes rollers 22 interconnected by coupling links 23. Rollers 22 ride on support flanges 24 secured to frame members 25 so that the series of flights 18 are positively supported in the particle treatment zone 12.

A series of individual conveying compartment subassemblies 26, discussed in greater detail below, are attached to flights 18 and form compartments into which particulate material 11 is disposed for treatment. The conveying compartments restrict the movement of the particulate material 11 so that they are substantially maintained at a position on conveyor 16 while being fluidized, thereby significantly contributing to the uniform treatment of the material as it passes through treatment zone 12.

The air flow system provides flow of fluidizing air to the particle treatment zone 12 and includes insulated housing 36 mounted on supports 38. Extending downwardly from housing 36 toward and over the particle treatment zone 12 is an array of elongated tubes 40. Each tube 40 is about 0.5 meter in length and has an inner diameter of about two centimeters with the tubes arranged in alternating rows of eight and nine in number. The rows of tubes 40 are alternately offset, width-wise, from each other to provide a more uniform distribution of fluidizing air to treatment zone 12. The tubes are spaced at intervals of about nine centimeters on center between tubes and six centimeters on center between rows.

Figure 4:
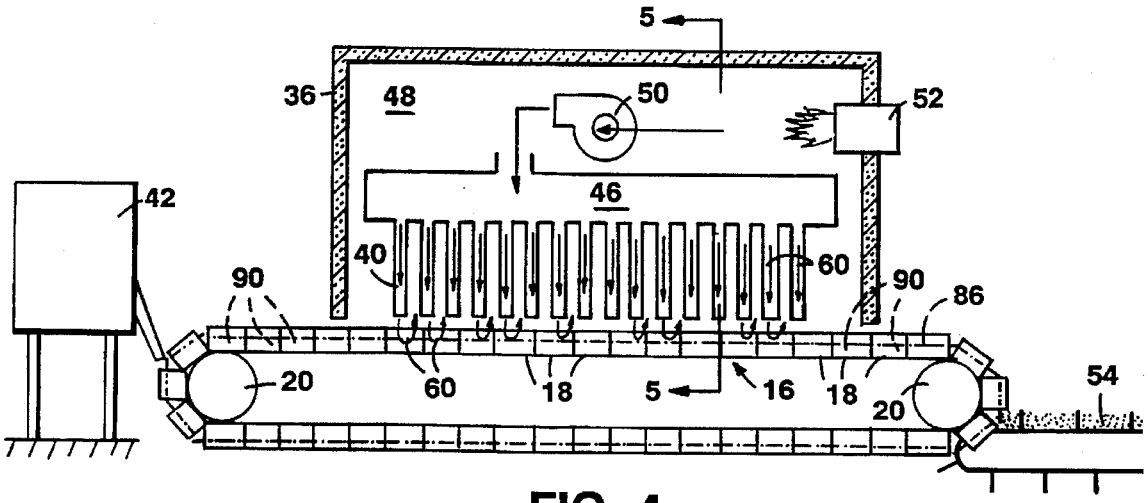
FIG. 4 is a diagrammatical cross-sectional side view of the system shown in FIG. 1.
Figure 5:
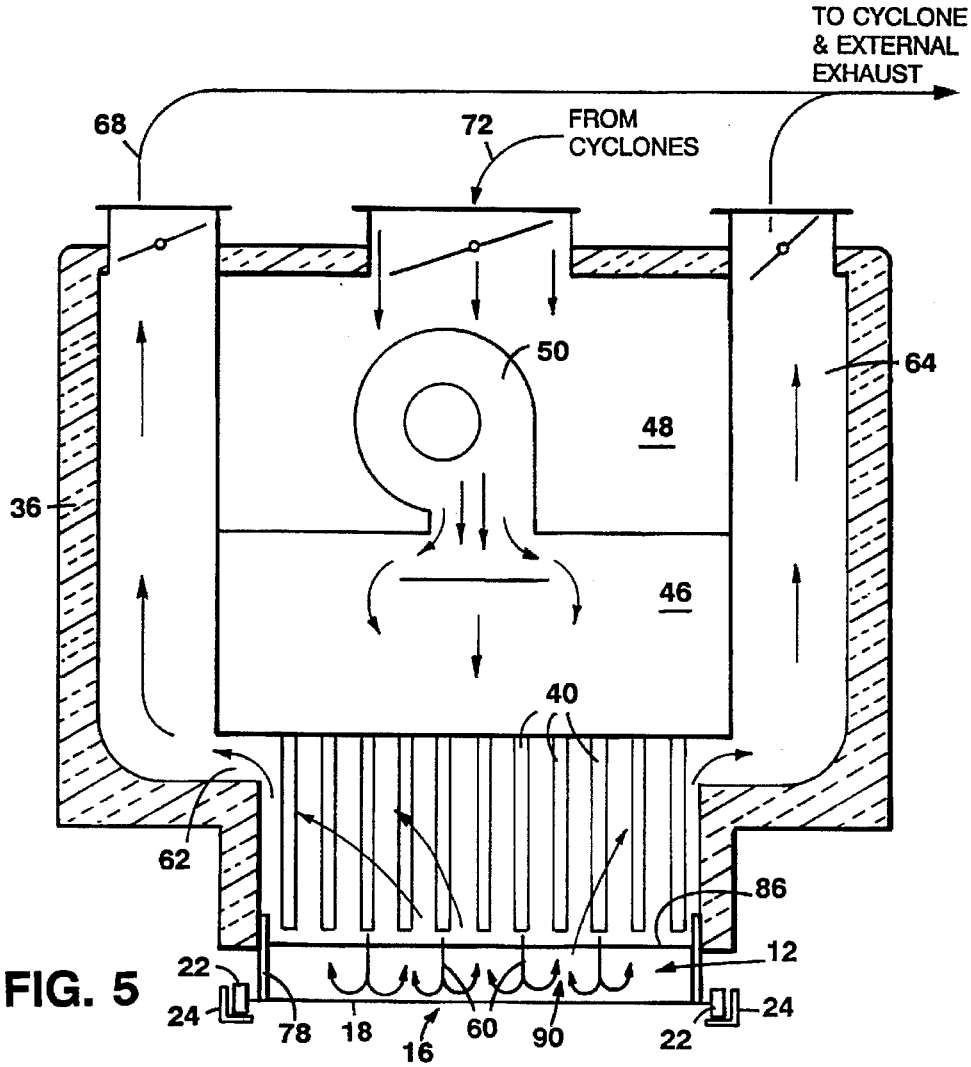
FIG. 5 is a diagrammatical cross-sectional view taken along the line 5—5 of FIG. 4.
Figure 6:
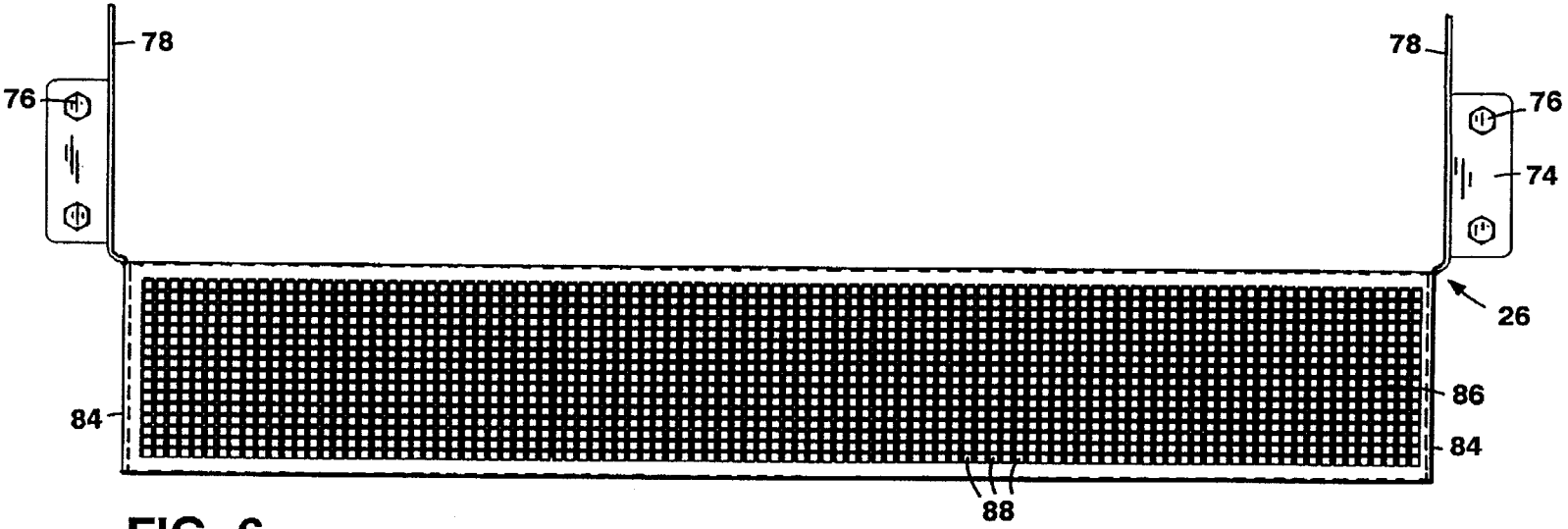
FIG. 6 is a top view of a compartment subassembly including a foraminous retention member.
Figure 8:
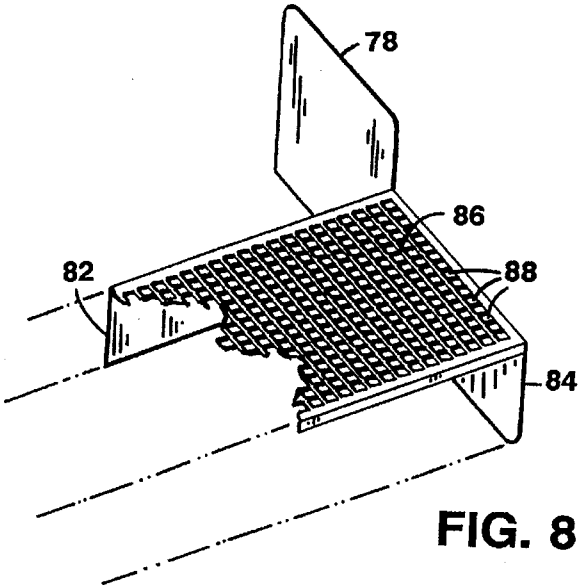
FIG. 8 is a perspective view of a portion of the compartment subassembly.
Figure 7:
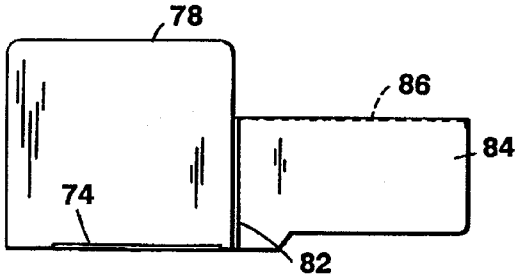
FIG. 7 is a side view of the compartment subassembly of FIG. 6.

As shown in FIGS. 4 and 5, conditioning plenum 48 is formed in housing 36 above pressure plenum 46. The air to be supplied to the treatment zone 12 is conditioned in plenum 48 by heater 52 and then transferred by blower 50 to pressure plenum 46 for downward discharge in high velocity streams 60 from tubes 40 through screens 86 into compartments 90. It will be understood that the gas may be conditioned by cooling or otherwise as desired in other treatment systems. Material treatment systems may include multiple treatment zones with a corresponding number of conditioning plenums, blowers, pressure plenums, and heaters for treating various other products.

Elongated exhaust ports 62 extend along each side of treatment zone 12 and communicate with series flow paths that include exhaust chambers 64, transfer conduits 68 at the top of housing 36. Conduits 68 are connected to cyclones 70 and optionally to external exhausts (not shown). The gas from the cyclones 70 is returned to the housing 36 through ducts 72 for flow into the conditioning plenum 48 for conditioning and then transferred by blower 50 to pressure plenum 46.

Referring to FIGS. 2 and 6–8, each conveying compartment subassembly 26 includes a pair of vertical end walls 78 which define the side boundaries of the treatment zone and flanges 74 are of shorter length than flights 18. End walls 78 have a height of about fifteen centimeters which allow them to extend above the openings of tubes 40 and the lower portion of housing 36, thereby directing the exhausted fluidized air toward exhaust ports 62. In addition, each conveying compartment subassembly 26 includes a vertical transverse side wall 82 that spans the width of conveyor 16 and has a height of about nine centimeters. Each wall 82 is attached near a hinge point 31 along the length of a corresponding flight 18 and to end walls 78.

Each conveying compartment subassembly 26 also includes end wall extensions 84 to which retention (screen) member 86 is rigidly welded as well as to the vertical side wall 82 which extends transversely toward the other vertical end wall thereby serving as a cover for the conveying compartment. Retention screen 86 is positioned between the particulate material 11 and the air flow system during the time the material is being treated within treatment zone 12. Retention screen 86 is about ¾ meter long and is formed of a perforated metal plate having holes 88 sized and spaced on the basis of the size and type of the particular particulate material being treated. Generally, the size of holes 88 is about ninety percent of the smallest dimension of the product being processed, thereby insuring the retention of particulate material 11 within the six sides of the conveying compartments while allowing the free flow of fluidizing air to enter conveying compartments 90 from above. End openings of tubes 40 are spaced from the retention screen 86 a distance in a range between 0.5 and 3.0 centimeters and nominally about 1.5 centimeters.

The series of travelling conveying compartments 90 are formed of subassemblies 26, each subassembly including the pair of endwalls 78, a transverse side wall 82 and a retention screen 86 supported on end wall extensions 84 and side wall 82. Each subassembly 26 includes coupling flanges 74 that have holes which receive bolts 76 for rigidly securing each subassembly 26 to a corresponding conveyor flight 18. Retention screen 86 extends transversely, in cantilever fashion, from the top of side wall 82 spanning end wall extensions 84. Thus, the retention screen 86 and side wall 82 of one subassembly 26 cooperates with end walls 78 and side wall 82 of the next adjacent subassembly 26 to form a conveying compartment 90.

Figure 9:
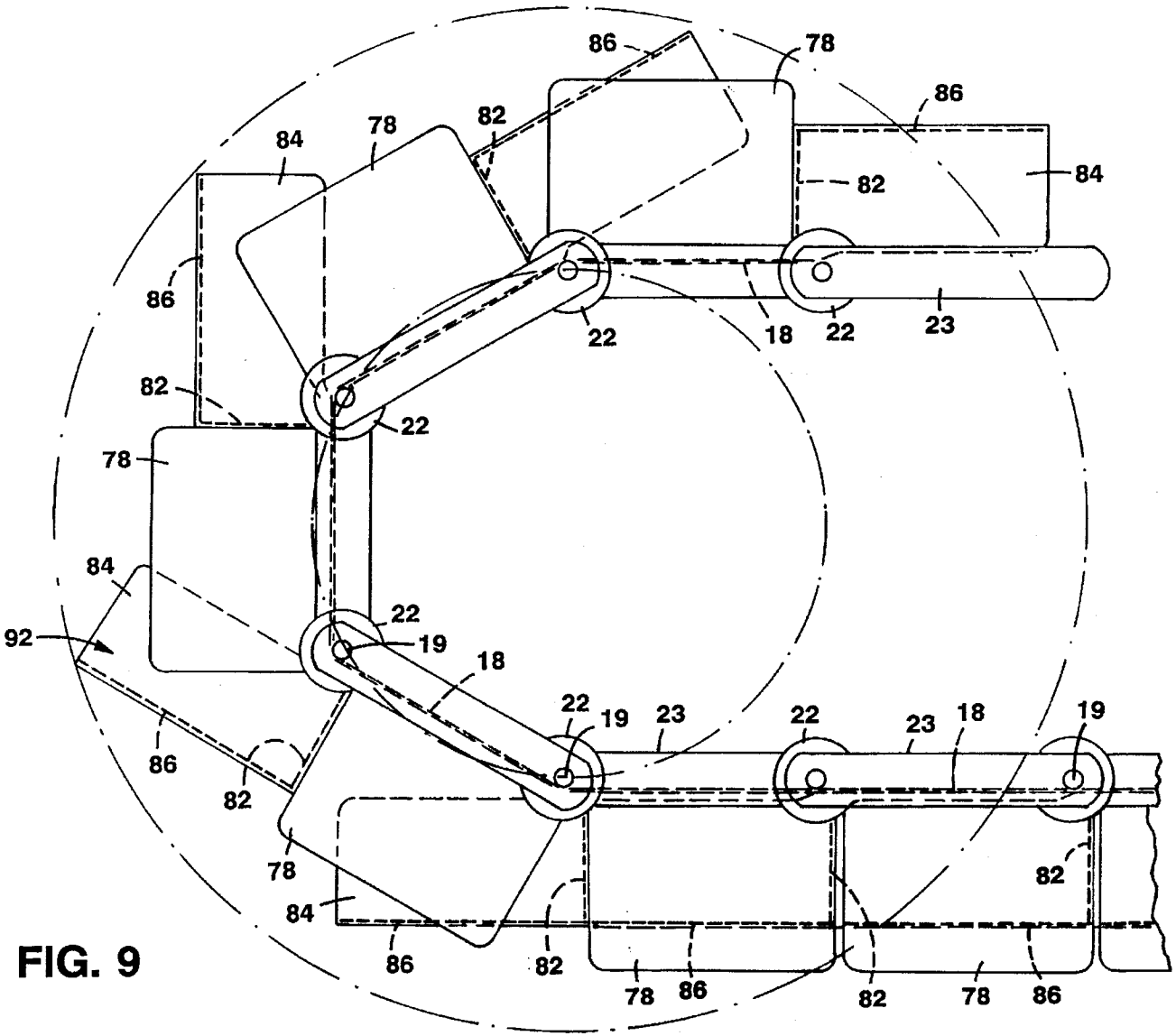
FIG. 9 is a side view of the feed end of the conveyor system.

As shown in FIGS. 4 and 9, in operation, conveying compartments 90 which have discharged their treated particulate material are now travelling along the underside toward the feed end of conveyor 16. A metered amount of particulate material 11 is fed into each conveyor compartment 90 from a synchronized feed apparatus 42 mounted at the end of conveyor 16. Referring to FIG. 9, as each conveyor compartment 90 approaches the feed end of conveyor 16 and rounds the sprocket assembly 20, the pair of end wall extensions 84 and screen 86 of the conveying compartment 90 begin to hingedly separate from flight 18, thereby providing a widening opening 92. During this period in which the conveying compartment 90 is open (about 4.5 seconds), particulate material 11 is transferred from feed apparatus 42 into the conveying compartment 90. As the flight 18 and conveying compartment 90 continues around sprocket assembly 20, opening 92 begins to close and finally forms an enclosed containment structure when retention screen 86 is parallel with its flight 18 and is closed by side and end walls 78, 82. The particulate material in the conveyor compartment 90 enters the treatment zone 12 where it is subjected to fluidization. Heated air from the air flow system flows through tubes 40 in high velocity streams 60 directed perpendicularly downwardly through screens 86 into conveyor compartments 90. The velocity of jet streams 60 is such that they pass through particles 11 and impinge on the imperforate surfaces of flights 18. The heated air is deflected radially outwardly from the axis of each jet and tends to pass under particles 11 and lifts them off the conveyor flights 18 in fluidizing action. The staggered arrangement of tubes 40 in successive transverse rows produces lateral movement of the fluidized particles 11 on the conveyor 16 as the particulate material is advanced through treatment zone 12 by the conveyor compartments 90.

During fluidization of the particulate material 11 in treatment zone 12, the six sides of compartments 90 formed by the imperforate surface of flights 18, vertical side walls 82, end walls 84, and foraminous retention screen 86 move as a unit and constrain the particles to travel with and be retained in the compartments 90. Thus, the individual particles within the compartments are treated uniformly as they pass through treatment zone 12.

Figure 10:
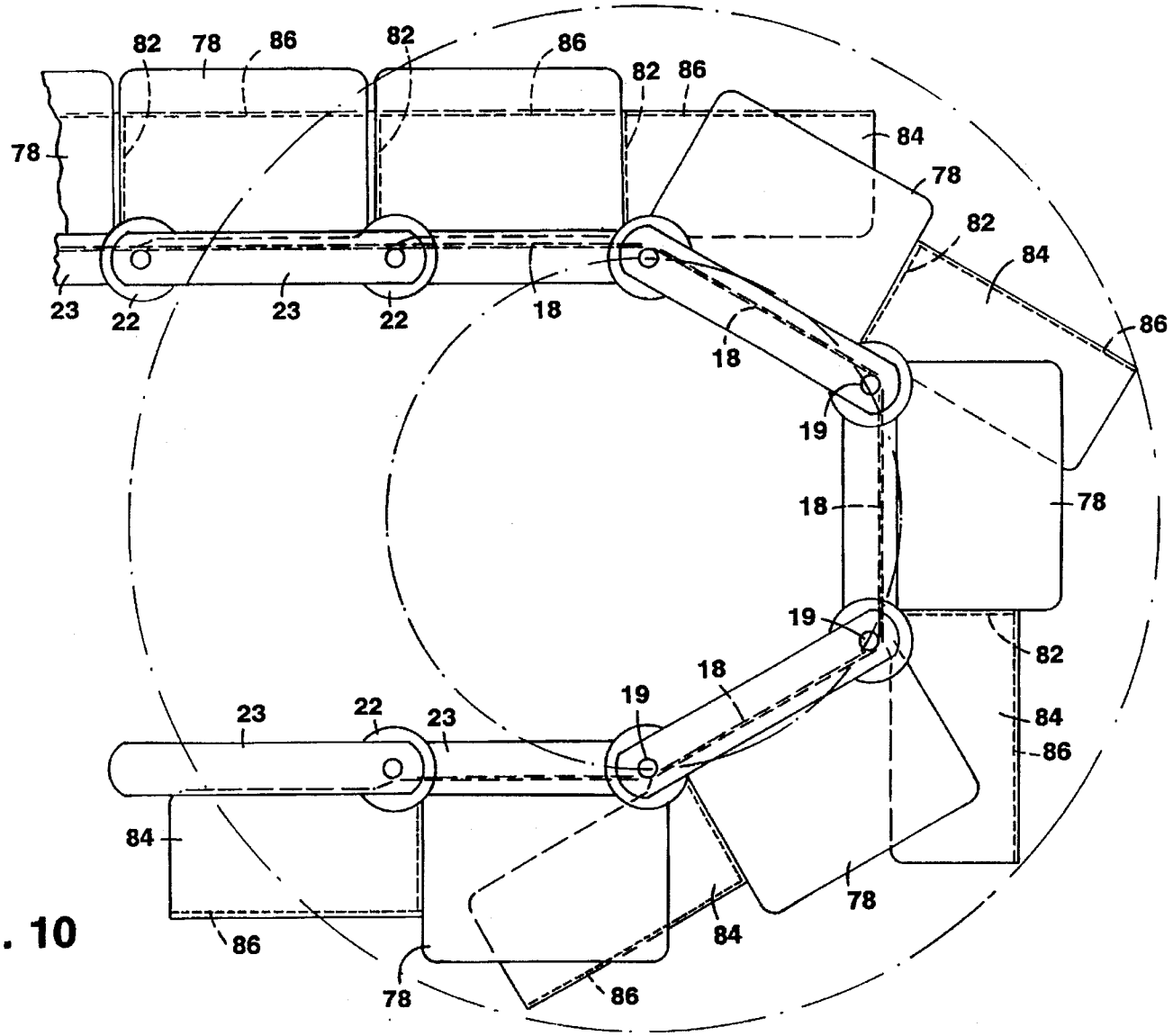
FIG. 10 is a side view of the discharge end of the conveyor system.

With reference to FIGS. 4 and 10, upon reaching the end of conveyor 16 each conveying compartment 90 rounds discharge sprocket assembly 20 and, in similar fashion as described above in conjunction with the feed end of the system, the end wall extension 84 and screen 86 of each compartment hingedly separate from its preceding compartment and open to allow the treated particulate material 11 to be discharged. The discharged particulate material is then packaged, or conveyed to a further conveyor system 54 (FIG. 4) for further processing such as cooling.

The process parameters of the particle treatment system vary depending on the type and desired processing of the specific particulate material being treated. Referring to the table below, the process control parameters for various materials are shown.

| Material | Temp. (°C.) | Dwell time (min.-sec) | Airflow Velocity (mpm) | Hole size (mm) | Hole spacing (mm) | Tube spacing from screen (cm) |
|---|---|---|---|---|---|---|
| Potato chips | 185 | 12–0 | 3400 | 7 | 9 | 10 |
| Puffed extruded snacks | 288 | 0–30 | 2900 | 7 | 9 | 10 |
| Roast Corn Kernels | 204 | 6–45 | 3100 | 3.4 | 3 | 9 |
| Infused Blueberries | 93 | 25–0 | 3050 | 3.4 | 3 | 9 |

The fluidizing system described above is of particular use in the food industry but has other heating, cooling and chemical reaction applications. The conveyor compartments provide both a containing function as well as contributing to fluidizing the particulate material. While particular embodiments of the invention have been shown and described, various modifications will be apparent to those skilled in the art and therefore it is not intended that the invention be limited to the disclosed embodiments or to details thereof and departures may be made therefrom within the spirit and scope of the invention as defined in the claims.

What is claimed is:

1. A material treatment system comprising structure defining a particle treatment zone, a gas flow system disposed above said particle treatment zone for placing particulate material in fluidized condition as they move through said treatment zone, and exhaust structure for moving gases from said treatment zone away from said particle treatment zone, said structure comprising:

transport conveyor structure arranged for transporting said particulate material through said particle treatment zone, said conveyer structure including structure defining a lower boundary of said particle treatment zone, and conveying compartment structure, cooperating with said lower boundary structure, for transporting said particulate material through said particle treatment zone, and foraminous retention structure disposed between said gas flow system and said conveying compartment structure, said foraminous retention structure for travel with and retention of particulate material within said conveying compartment structure, and said gas flow system arranged to project gaseous streams downwardly through said foraminous retention structure for fluidizing said particulate material within said conveying compartment structure.

2. The system as claimed in claim 1 wherein said conveying compartment structure comprises a series of individual conveying compartments.

3. The system as claimed in claim 2 wherein each conveying compartment comprises imperforate bottom structure defined by said lower boundary structure of transport conveyor structure, a vertically extending side wall extending across the width of the transport conveyor structure, and vertically extending end walls extending along the travelling length of said transport conveyor structure, said end walls being transverse to said side wall, and wherein said foraminous retention structure is substantially in contact with said side wall and end walls when said compartments are within said particle treatment zone.

4. The system as claimed in claim 1 wherein said foraminous retention structure comprises a perforated metal sheet.

5. The system as claimed in claim 1 wherein said foraminous retention structure has a multiplicity of holes, each said hole having a dimension less than about ninety percent of a smallest dimension of the particular material to be processed.

6. The system as claimed in claim 1 wherein said lower boundary defining structure is of the endless belt type.

7. The system as claimed in claim 1 wherein said gas flow system comprises a supply plenum above said treatment zone, an array of nozzles extending along the length of the particle treatment zone and across the width of the zone and arranged for flowing gas from said supply plenum downwardly in high velocity streams towards said conveyor for fluidizing particles on said conveyer, and means for exhausting gas from said high velocity streams upwardly away from said treatment zone.

8. The system as claimed in claim 7 wherein the vertical spacing between said array of nozzles and said foraminous retention structure is between 0.5 and 3.0 centimeters.

9. A material treatment system comprising structure defining particle treatment zone, a gas flow system disposed above said particle treatment zone for placing particulate material in fluidized condition as they move through said treatment zone, and exhaust structure for moving gases from said treatment zone away from said particle treatment zone, said structure comprising:

transport conveyor structure arranged for transporting said particulate material through said particle treatment zone, said conveyer structure including lower boundary structure defining a lower boundary of said particle treatment zone, conveying compartment structure cooperating with said lower boundary structure, for transporting said particulate material through said particle treatment zone, and foraminous retention structure disposed between said gas flow system and said conveying compartment structure, said foraminous retention structure for retention of particulate material within said conveying compartment structure, said gas flow system arranged to protect gaseous streams downwardly through said foraminous retention structure for fluidizing said particulate material within said conveying compartment structure, said conveying compartment structure comprising a series of individual conveying compartments, each said individual conveying compartment being defined by:

said lower boundary structure of said transport conveyor structure, and a compartment subassembly attached to said lower boundary structure, said compartment subassembly comprising a vertically extending side wall extending across the width of the transport conveyor structure, vertically extending end walls extending along the sides of the travelling length of the transport conveyor structure, and said foraminous retention structure, a pair of said vertically extending end walls, and a said vertically extending side wall of one of said subassemblies and a said vertically extending side wall of an immediately adjacent compartment subassembly forming an individual conveying compartment.

10. A particle treatment system comprising:

structure defining a particle treatment zone including a belt type conveyer that has an imperforate surface defining a lower boundary of the particle treatment zone and being arranged for transporting particulate material through the treatment zone, a supply plenum above said particle treatment zone, an array of nozzles arranged to project gaseous streams downwardly from said supply plenum against said conveyor surface for fluidizing particles on said conveyer, means for exhausting gases from said treatment zone upwardly away from said conveyer, conveying compartment structure secured to said belt type conveyer for transporting said particulate material through said particle treatment zone, and foraminous retention structure disposed between said nozzles and said conveying compartment structure, said foraminous retention structure travel with and retention of particulate material within said conveying compartment structure.

11. The system of claim 10 wherein said foraminous retention structure comprises perforated metal sheet structure.

12. The system of claim 10 wherein said foraminous retention structure has a multiplicity of holes, each said hole having a dimension less than about ninety percent of a smallest dimension of the particulate material to be processed.

13. The system of claim 10 wherein said foraminous retention structure is of the endless belt type.

14. The system as claimed in claim 13 wherein said conveying compartment structure comprises a series of individual conveying compartments.

15. The system of claim 10 wherein said supply plenum and said array of nozzles are arranged to flow said gaseous streams at a velocity of one thousands meters per minute.

16. A particle treatment system comprising:

structure defining a particle treatment zone including a belt type conveyer that has an imperforate surface defining a lower boundary of the particle treatment zone and being arrange for transporting particulate material through the treatment zone, a supply plenum above said particle treatment zone, an array of nozzles arranged to project gaseous streams downwardly from said supply plenum against said conveyor surface for fluidizing particles on said conveyer, means for exhausting gases from said treatment zone upwardly away from said conveyer, conveying compartment structure cooperating with said belt type conveyer for transporting said particulate material through said particle treatment zone, and foraminous retention structure disposed between said nozzles and said conveying compartment structure for travel with and retention of particulate material within said conveying compartment structure, each conveying compartment comprising a bottom defined by said belt type conveyor surface, a vertically extending side wall extending across the width of said belt type conveyor, and vertically extending end walls extending along the travelling length of said belt type conveyor structure, said end walls being transverse to said side wall, and said foraminous retention structure providing a compartment cover secured to said side wall and end walls.

17. The system of claim 16 wherein said foraminous retention structure comprises perforated metal sheet structure.

18. The system of claim 16, wherein said foraminous retention structure has a multiplicity of holes, each said hole having a dimension less than about ninety percent of a smallest dimension of the particulate material to be processed.

19. The system of claim 18 wherein said foraminous retention structure is parallel to said belt type conveyer in said treatment zone and spaced between 0.5 and 3.0 centimeters from the lower ends of said nozzles.

20. The system of claim 19 wherein said holes have a width dimension of less than two centimeters.

21. The system of claim 20 wherein said belt type conveyor includes a series of flights that are hingedly interconnected, each said flight forms the base of a compartment and said foraminous retention structure includes a series of screen members, each said screen member having a width corresponding to the width of a conveyor flight and being longitudinally offset from the conveyor flight on which it is mounted.

* * * * *